United States Patent [19]

Elkin

[11] 4,148,023

[45] Apr. 3, 1979

[54] EMERGENCY EXIT INDICATOR

[75] Inventor: Barry Elkin, New York, N.Y.

[73] Assignee: E.D.I. Safety Devices, Inc., Greenlawn, N.Y.

[21] Appl. No.: 792,809

[22] Filed: May 2, 1977

[51] Int. Cl.[2] ..... G08B 17/10; G08B 7/00

[52] U.S. Cl. ..... 340/628; 340/326; 340/332; 340/371

[58] Field of Search ..... 340/237.5, 331, 332, 340/333, 326, 628, 629, 630, 371; 315/86, 87

[56] References Cited

U.S. PATENT DOCUMENTS

| | | | |
|---|---|---|---|
| 3,500,368 | 3/1970 | Abe | 340/237.5 |
| 3,916,404 | 10/1975 | Gouge | 340/371 |

*Primary Examiner*—John W. Caldwell, Sr.

*Assistant Examiner*—Daniel Myer

*Attorney, Agent, or Firm*—Amster, Rothstein & Engelberg

[57] ABSTRACT

An emergency exit indicator that will signal the location of an emergency exit by a high intensity smoke piercing light and audible alarm, becoming activated automatically when smoke reaches a predetermined level. This indicator is particularly useful in movie theatres, night clubs and similar places where it is necessary to utilize subdued exit lights that will not be distracting. In cases of emergency involving smoke, the emergency exit indicator of this invention becomes activated automatically, thereby emitting a powerful beam of light capable of piercing through substantial distances of dense smoke. However, when the indicator is not activated it will not cause a distraction.

8 Claims, 3 Drawing Figures

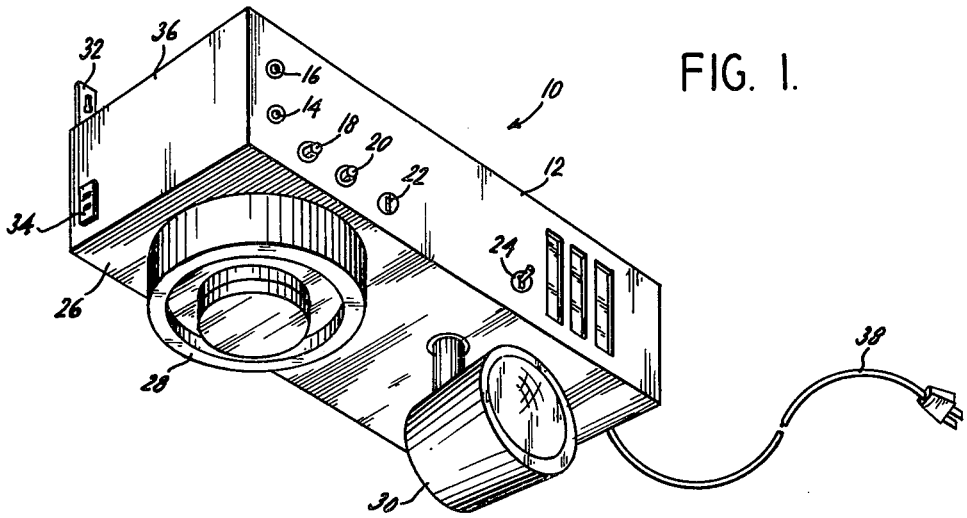
FIG. 1.
FIG. 2.
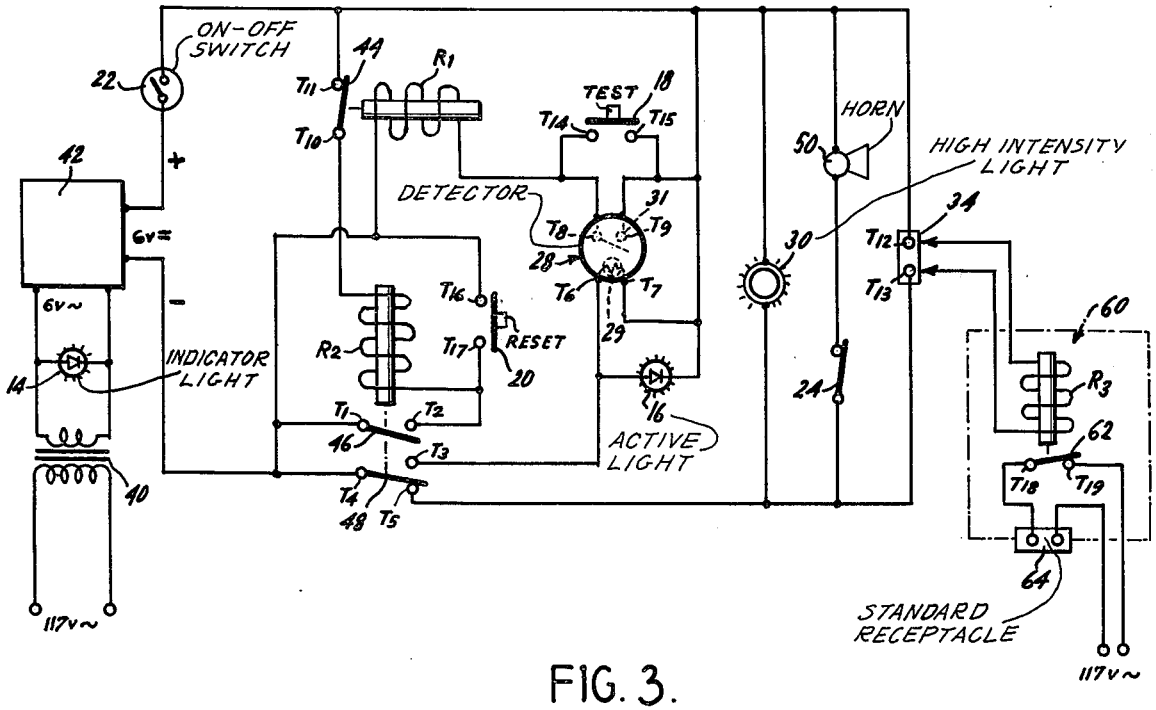
FIG. 3.
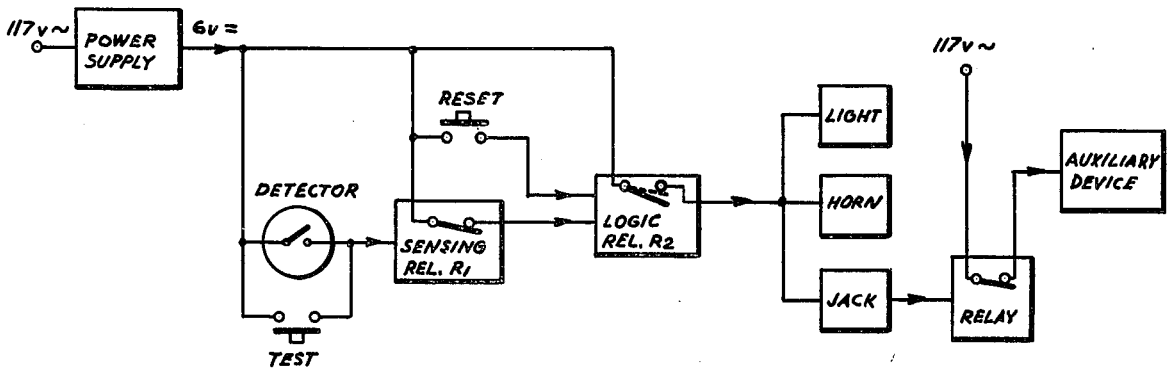

EMERGENCY EXIT INDICATOR

The present invention relates generally to an emergency exit indicator which will aid persons in movie theatres, night clubs, sports arenas and other large rooms in locating emergency exits during a fire or similar emergency.

The most commonly used type of conventional emergency exit light contains a low intensity, illuminated sign indicating the location of an exit. This sign is specifically designed to avoid being a distraction to patrons in a movie theatre, restaurant, night club or similar establishment where a low light level is maintained. In the event of smoke resulting from fire, explosion or a natural disaster, a conventional low intensity exit light is ineffective as a means of locating the emergency exits, as such low intensity light is not capable of being seen through smoke-filled air more than a short distance.

Similarly, as the causes of smoke are frequently associated with conditions that cause the loss of power, conventional exit lights often do not remain lit in such circumstances, obviously adding to their overall ineffectiveness.

In those instances where the smoke is too dense to allow vision more than a few feet, it would be desirable to have an audible indicator enabling occupants of the building to locate the emergency exit by sound. Conventional emergency exit lights do not have this capability.

It is broadly an object of the present invention to provide an improved emergency exit indicator device which overcomes one or more of the foregoing disadvantages of conventional exit lights. Specifically, it is within the contemplation of the present invention to provide a new and improved emergency exit indicator that contains a high intensity indicator light that is automatically activated when a predetermined level of smoke is detected within a building or room.

It is a further object of the present invention to provide an emergency exit indicator device that is capable of operating independently from the power source of the building in which it is located, thereby being fully effective in conditions where the electrical power has been lost incident to the condition causing smoke in the building.

It is a further object of the present invention to provide an audible signal to supplement the high intensity light source to assist occupants in locating the emergency exit.

It is a further object of the present invention to provide an emergency exit indicator device containing bypass circuitry that will continue to activate the high intensity lamp and/or the audible alarm notwithstanding damage to the smoke detector assembly or some associated circuitry once the emergency exit indicator device has become activated.

It is a further object of the present invention to provide a means for activating related accessories such as supplemental emergency lights, standby or power failure lights, central alarm systems and similar devices.

It is a further object of the present invention to provide an emergency exit indicator that is compact and easily installed.

In accordance with an illustrative embodiment demonstrating objects and features of the present invention, there is provided an emergency exit indicator comprising power supply means, door location signaling means and smoke detecting means operatively connecting the power supply means to the door location signaling means. The smoke-detecting means includes a smoke detector assembly and switching means actuated by the smoke detector assembly. The smoke detecting means is contructed and arranged to cause the switching means to switch power from the power supply means to the door location signaling means when a predetermined level of smoke is detected by the smoke detector assembly.

The above description as well as further objects, features and advantages of the present invention will be more fully understood by reference to the following detailed description of a presently preferred, but nonetheless illustrative embodiment in accordance with the present invention, when taken in conjunction with the accompanying drawings, wherein:

FIG. 1 is a perspective view of the emergency exit indicator device illustrating the invention disclosed herein;

FIG. 2 is an electrical schematic drawing of an illustrative circuitry of said emergency exit indicator; and FIG. 3 is a logic diagram showing the various functional modules in an emergency exit indicator of the present invention.

Referring now specifically to the drawings, and in particular to FIG. 1, there is shown in illustrative emergency exit indicator device generally designated by the reference numeral 10. The front panel 12 of the indicator device 10 contains a line power indicator 14 and a detecting mode indicator 16. Both indicators are preferably made from a light emitting diode for higher reliability and lower power consumption. The front panel 12 also contains a momentary test switch 18 and a momentary reset switch 20, as well as a key operated on-off switch 22 and an audible alarm cut-off switch 24.

The bottom surface 26 of the indicator device 10 is substantially horizontal. A smoke detector assembly 28 is fixedly mounted to the bottom surface 26 in such manner that the smoke detector assembly 28 will be in its most advantageous orientation for the detection of smoke within a room.

A high intensity light assembly 30 is adjustably mounted to the bottom surface 26 of the indicator device 10 so that the light asembly 30 will be capable of being directed and fixed in such position that when the emergency exit indicator device 10 is mounted above or adjacent an emergency exit the light beam can be used as a beacon by occupants in the room. By moving towards the source of the light it would be possible for an occupant of the room to locate the emergency exit.

The indicator device 10 of the present invention is provided with mounting brackets 32 enabling the indicator device 10 to be fixedly mounted to the wall or similar surface directly above or adjacent to an emergency exit. It is within the purview of this invention to locate the smoke detector assembly 28 at a more advantageous location remote from the indicator device 10; however, the high intensity light assembly 30 is most advantageously located directly above or adjacent the emergency exit.

An added feature of the present invention is an accessory jack 34 located on one side panel 36 of the indicator device. The accessory jack 34 will enable the operation of auxiliary devices such as additional standby (power failure) light sources, central alarm units and similar devices by the activation of the circuitry comprising the indicator device 10.

In order to install the emergency exit indicator device 10 it is merely necessary to attach mounting bracket 32 to the wall and to plug line cord 38 into a convenient wall socket. Most preferably, line cord 38 is attached to a step-down transformer 40 (shown in FIG. 2) which reduces the voltage of the line current to approximately 6 volts A.C. The 6 volt current is then carried the necessary distance from the step-down transformer 40 located near the wall socket to the indicator device 10 mounted near an emergency exit. As a wall socket might not always be located conveniently with respect to the emergency exit it is preferred, for safety reasons, to have the 6 volt current running the greater distances rather than line current.

As shown by the schematic curcuit diagram of an embodiment of the present invention, the emergency exit indicator device 10 operates in the following manner. The line current at 117 volts A.C. enters step-down transformers 40 wherein it is reduced to approximately 6 volts A.C. Line power indicator 14 is connected across the secondary windings of step-down transformer 40 to indicate that line power is being put into the indicator device 10. As described above, the line power indicator 14 is preferably a light emitting diode.

Next, the 6 volt A.C. input current is fed into power supply assembly 42. Power supply assembly 42 contains rectifying curcuitry, a rechargeable 6 volt battery and recharging circuitry that is adapted to constantly maintain the battery in a fully charged state. Internal circuitry within power supply assembly 42 rectifies the 6 volt A.C. input into 6 volt D.C. output and charges the battery within the power supply assembly 42 as required. In the event of power failure the battery will continue the operation of the emergency exit indicator device 10.

In FIG. 2, reference numeral 22 denotes the key operated on-off switch which operates the circuitry after the output of the power supply assembly 42. The operation of the on-off switch 22 does not interfere with the charging of the battery within the power supply assembly 42. When key operated switch 22 is tuned to the "off" position the emergency exit indicator device 10 is deactivated. The utilization of a key operated switch prevents the unauthorized deactivation of the device.

FIG. 2 shows relay R1 having a single contact 44 which is in the normally closed position. Relay R2 has a normally open contact 46 and a double throw contact 48.

As shown in FIG. 2 the indicator device 10 is in the triggered mode. That is, if on-off switch 22 is placed in the "on" position, current will be directed into the high intensity light assembly 30 and the audible alarm or horn means 50 by relays R1 and R2. In order to place the indicator device in the detecting mode it is necessary to manually reset the relays R1 and R2 by momentarily pressing the momentary reset switch 20. While in the detecting mode relay R1 remains de-energized with normally closed contact 44 remaining closed, allowing current to activate the coil of relay R2 while the reset is held down. Once relay R2 is activated, normally open contact 46, which is in series with the coil of relay R2 closes causing current to flow from terminal T1 to T2 maintaining relays R2 in the activated state after reset switch 20 is released. Simultaneously, the double throw contact 48 of relay R2 moves out of engagement with terminal T5, thereby deactivating light assembly 30 and horn means 50, and comes into engagement with terminal T3, causing current to flow from terminal T4 to T3. Thus, double throw contact 48 of relay R2 causes the lamp element 29, across terminals T6 and T7, within the smoke detector assembly 28 to become activated. Finally, detecting mode indicator 16 becomes lit indicating that the emergency exit indicator device 10 is in the detecting mode.

The emergency indicator device 10 of the present invention can utilize an otherwise conventional smoke detector assembly 28 of either the ionization or photoelectric type. The preferred embodiment of the present invention utilizes a photoelectric detector which contains a lamp element 29, across terminals T6 and T7, which directs a light beam into a chamber. The chamber contains a light-sensitive photo cell, which is normally out of the path of the direct bean of lamp element 29. When smoke enters the chamber, the smoke particles disperse the light beam and the photo cell then detects light. At a preset level of smoke internal switching means 31 within the smoke detector assembly 28 closes, completing the circuit between terminals T8 and T9.

In operation of the emergency indicator device 10, when a predetermined level of smoke is detected the internal switching means 31 (represented in phantom lines as a single pole, single throw switch) in the smoke detector assembly 28 closes causing current to pass between terminals T8 and T9 on the smoke detector assembly 28. Once the circuit is completed across terminals T8 and T9, relay R1 becomes activated, thereby causing normally closed contact 44 of relay R1 to open. The opening of normally closed contact 44 interrupts the current flowing between terminals T10 and T11, thereby deactivating the relay R2. Once deactivated, the double throw contact 48 of relay R2 interrupts the current flowing between terminals T4 and T3 and causes current to flow between terminals T4 and T5. At the same time, normally open contact 46 of relay R2 returns to its normally open position interrupting the flow of current between terminals T1 and T2.

The motion of double throw contact 48 of relay R2 interrupts the flow of current to the light means 29 within smoke detector assembly 28 and to the detecting mode indicator 16. Simultaneously, the current is caused to flow between terminals T4 and T5, thereby causing the high intensity light assembly 30 to become activated and, if the audible alarm cut-off switch 24 is in the closed position, the horn means 50 will also sound. Finally, terminals T12 and T13 of accessory jack 34 become activated.

To test the operation of the emergency exit indicator device 10 test switch 18 is depressed momentarily, thereby completing the circuit between terminals T14 and T15. The momentary activation of test switch 18 causes the indicator device 10 to instantaneously change from the detecting mode to the triggered mode in the same manner that the indicator device 10 operates when the internal switching means 31 within the smoke detector assembly 28 is closed causing current to flow between terminals T8 and T9. In order to again place the indicator device 10 in the detecting mode it is necessary to momentarily press the reset switch 20 thereby completing the circuit between terminals T16 and T17, activating relay R2. Test switch 18 at its location in the circuitry simulates the signal from the smoke detector assembly 28 and actuation of test switch 18 tests the operation of all circuitry, including the relays R1 and R2.

FIG. 3 shows block diagramatically the operation of the emergency exit indicator device 10 of this invention. Briefly, alternating current of approximately 117 volts (line current) is supplied to the power supply assembly which contains rectifying circuitry, battery charging circuitry and an integral, rechargeable battery. The output from the power supply assembly of approximately 6 volts, direct current, is fed to a smoke detector which is schematically represented by a normally open, single pole, single throw switch. A sensing relay (relay R1) is maintained in the normally closed position when deactivated causing current to flow to the logic relay (relay R2). Relay R2 contains two contacts one of which is normally open and is held in the closed position only while relay R2 is activated. The second contact of relay R2 is a double throw contact which, when relay R2 is activated, allows power to enter the light source in the detector assembly 28. When the detector measures a predetermined level of smoke the internal switch closes, sending current into relay R1 causing its normally closed contact to open. Relay R2 is thereby deactivated allowing the double throw contact to complete the circuit to the light assembly, the horn means and other output devices such as the accessory jack. Once relay R2 is deactivated (in the triggered mode) the detector, relay R1 and relay R2 are removed from the circuit and, until the indicator device 10 is reset, the operability of the detector, relay R1 or relay R2 do not interfere with the continuous operation of the light assembly or horn means.

FIG. 2 also shows, in schematic form, the operation of an auxiliary relay assembly that will simulate a line current failure condition to enable conventional standby lighting assemblies to be used in conjunction with the indicator device 10 of the present invention, as will be discussed more fully below.

The circuitry of the present invention is constructed and arranged so that once the emergency exit indicator device 10 switches from the detecting mode to the triggered mode the smoke detector assembly 28 and the associated relays R1 and R2 are taken out of the circuit. That is, once the light assembly 30 or horn means 50 becomes activated, it remains activated until the indicator device 10 is manually reset by depressing the reset switch 20 or until the key operated on-off switch 22 is switched to the "off" position. In the latter instance the circuitry must be manually reset when the switch 22 is turned to "on". If there is a power failure while the light assembly 30 or horn means 50 is activated the battery within the power supply assembly 42 will assure that the door location indicating means continues to operate.

In addition, if the smoke detector means is damaged by fire subsequent to the indicator device 10 becoming triggered, or if the operation of relays R1 or R2 become impaired by heat or similar causes once in the triggered mode, the operation of the light assembly 30 or horn means 50 is not affected. The indicator device 10 will continue to operate as long as there is line current available or until the power stored in the battery within the power supply 42 is totally depleted.

The feature of the present invention which allows the light assembly 30 and horn means 50 to operate independently of the smoke detector assembly 28 is of particular value when the smoke detector assembly 28 is located remotely from the emergency exit indicator device 10. In such instance a long length of interconnecting wire is required. In the event of damage to the interconnecting wire (or the smoke detector assembly 28) by the fire or similar mishap that caused the indicator device 10 to become triggered the indicator device 10 will remain triggered notwithstanding such damage.

It is within the purview of this invention to add stroboscopic circuitry to the high intensity light assembly 30 whereby the light output is enhanced without increasing the drain on the battery within the power supply assembly 42 in the event of a line current failure. The stroboscopic affect of the high intensity light assembly 30 will enable the use of an even higher intensity light means to enhance the effectiveness of the indicator device 10 in dense smoke.

It is also within the purview of this invention to substitute solid state or integrated circuitry in place of the discreet components shown in FIG. 2 and described. above.

An added feature of the present invention is an auxiliary relay that is particularly useful for supplementing the operation of the emergency exit indicator device 10 with existing standby or power failure lighting in many public buildings. Typically, a standby lighting assembly is plugged into line current. When line current is interrupted internal circuitry in the standby lighting assembly causes a battery powered light to become activated until line current is restored or the battery is depleted. The function of the auxiliary relay assembly 60 is to simulate the failure of line current when the indicator device 10 detects a predetermined level of smoke.

As shown in FIG. 2, the auxiliary relay assembly generally designated by the reference numeral 60 contains relay R3 having a normally closed contact 62. The auxiliary relay assembly 60 is plugged into wall current and the coil of relay R3 is attached to the accessory jack 34 on the emergency exit indicator device 10. A conventional standby light assembly (not shown) is plugged into the standard receptacle 64 on the auxiliary relay assembly 60.

In operation, when the emergency exit indicator device 10 detects a predetermined level of smoke the high intensity light assembly 30 and horn means 50 become activated. Similarly, current is caused to flow to terminals T12 and T13 of accessory jack 34 and to the coil of relay R3 causing normally closed contact 62 or relay R3 to open. The opening of normally closed contact 62 interrupts the line current flowing across terminals T18 and T19 of the standard receptacle 64, thereby simulating a failure of line current, causing the standby lighting device to become activated.

It is possible to substitute similar relay assemblies for the auxiliary relay assembly 60 to activate or deactivate other circuitry including central alarm systems and other emergency related devices.

A latitude of modification, change and substitution is intended in the foregoing disclosure. Accordingly, it is appropriate that the appended claims be construed broadly and in a manner consistent with the spirit and scope of the invention.

What is claimed is:

1. An emergency exit indicator comprising: power supply means, door location signaling means, smoke detecting means operatively connecting said power supply means to said door location signaling means, said smoke detecting means including a smoke detector assembly and switching means actuated by said smoke detector assembly, said switching means including means for switching said indicator from a detecting condition wherein said power supply means in interruptably connected to said door location signaling means through said smoke detecting means to a triggered condition wherein said power supply is directly operatively connected to said door locating signaling means bypassing said smoke detecting means responsive to the detection of a predetermined level of smoke by said smoke detector assembly whereby said door location signaling means remains actuated until said switching means is manually reset.

2. The emergency exit indicator as recited in claim 1 wherein said power supply means comprises voltage reducing means, rectifier means connected to said voltage reducing means, battery charging means connected to said rectifier means and a standby battery operatively connected to said battery charging means to provide output from said power supply means when input power to said power supply is discontinued.

3. The emergency exit indicator as recited in claim 1 wherein said door location signaling means is comprised of a high intensity light having a smoke piercing beam.

4. The emergency exit indicator as recited in claim 3 wherein said door location signaling means is further comprised of an audible alarm.

5. The emergency exit indicator of claim 1 wherein said switching means is comprised of a relay.

6. The emergency exit indicator as recited in claim 1 wherein said switching means is comprised of solid state circuitry.

7. The emergency exit indicator as recited in claim 1 wherein said smoke detector assembly is located from said door location signaling means.

8. A smoke actuated emergency exit indicator adapted to go from a detecting mode to a triggered mode when a predetermined level of smoke is detected comprising: power supply means, door location signaling means, smoke detecting means interruptably connecting said power supply means to said door location signaling means, said smoke detecting means being constructed and arranged to measure smoke density and to cause said indicator device to assume a triggered mode when a predetermined level of smoke density is measured by said detecting means and bypass switching means alternatively connecting said power supply means to said door location signaling means, said bypass switching means having circuitry directly connecting said power supply means to said door location signaling means bypassing said smoke detecting means when said indicator is in a triggered mode whereby said door location signaling means will remain actuated independently of the operability of said smoke detecting means until said bypass switching means is reset thereby switching said indicator to a detecting mode.

* * * * *